US008711051B2

(12) United States Patent
Yamagajo

(10) Patent No.: US 8,711,051 B2
(45) Date of Patent: Apr. 29, 2014

(54) ANTENNA DEVICE AND WIRELESS COMMUNICATION APPARATUS

(75) Inventor: Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 270 days.

(21) Appl. No.: 13/207,533

(22) Filed: Aug. 11, 2011

(65) Prior Publication Data

US 2012/0127055 A1 May 24, 2012

(30) Foreign Application Priority Data

Nov. 18, 2010 (JP) ..... 2010-258270

(51) Int. Cl.
*H01Q 1/50* (2006.01)

(52) U.S. Cl.
USPC ..... 343/850

(58) Field of Classification Search
USPC ..... 343/850, 702, 700 MS
See application file for complete search history.

(56) References Cited

U.S. PATENT DOCUMENTS

| | | | | |
|---|---|---|---|---|
| 7,298,340 | B2 | 11/2007 | Ohba | |
| 7,683,839 | B2 * | 3/2010 | Ollikainen et al. | 343/702 |
| 8,378,892 | B2 * | 2/2013 | Sorvala et al. | 343/700 MS |
| 8,436,774 | B2 * | 5/2013 | Wong et al. | 343/700 MS |
| 2004/0233109 | A1 * | 11/2004 | Ying et al. | 343/700 MS |
| 2006/0044187 | A1 | 3/2006 | Sager et al. | |
| 2010/0164829 | A1 | 7/2010 | Pulimi et al. | |

FOREIGN PATENT DOCUMENTS

| | | | |
|---|---|---|---|
| CN | 1695267 | A | 11/2005 |
| EP | 1361623 | | 11/2003 |
| JP | 2007-49325 | A | 2/2007 |
| JP | 2007-331205 | A | 12/2007 |
| JP | 2008-067052 | A | 3/2008 |
| JP | 2008-154107 | | 7/2008 |
| WO | WO-02/078124 | | 10/2002 |
| WO | WO-2004/047220 | | 6/2004 |

OTHER PUBLICATIONS

Extended European Search Report (EESR) dated Mar. 6, 2012, from corresponding European Application No. 11177391.7.

Rhyu, H. et al., "Multi-band hybrid antenna for ultra-thin mobile phone applications", Electronics Letters, vol. 45, No. 15, Jul. 16, 2009; pp. 773-774.

Liu, Luyi et al., "Electrically Small Antenna Tuning Techniques", Loughborough Antennas & Propagation Conference, Nov. 16, 2009; pp. 313-316.

Chinese Office Action mailed Nov. 19, 2013 for corresponding Chinese Application No. 201110325142.1, with English-language translation.

* cited by examiner

*Primary Examiner* — Huedung Mancuso
(74) *Attorney, Agent, or Firm* — Fujitsu Patent Center

(57) ABSTRACT

An antenna device includes a feed element being of a length that allows resonance in a specified frequency band, a distributed constant feed line grounded at one end and coupled at another end to the feed element to form a feeding point, a reactive element grounded at one end and coupled at another end to a position a specified distance from the feeding point of the feed line, a first switch disposed between the feed line and the reactive element and used to select whether the feed line and the reactive element are coupled or uncoupled, a parasitic element disposed adjacent to the feed element and being of a length that allows resonance in a frequency band different from the frequency band in which the feed element resonates, and a second switch used to select whether the parasitic element is grounded.

15 Claims, 12 Drawing Sheets

FIG. 5

| BAND | FREQUENCY (MHz) | CENTER FREQUENCY (MHz) | BANDWIDTH (MHz) | FRACTIONAL BANDWIDTH (%) | REMARK |
|---|---|---|---|---|---|
| 1 | 806-960 | 883 | 154 | 17.4 | FOMA PLUS + GSM800 + GSM900 |
| 2 | 1447.9-1510.9 | 1479.4 | 63 | 4.3 | DUE TO BE USED FOR LTE |
| 3 | 1710-1880 | 1795 | 170 | 9.5 | FOMA+GSM1800+GSM1900 |
| 4 | 1850-2167.6 | 2008.8 | 317.6 | 15.8 | FOMA |

ANTENNA DEVICE AND WIRELESS COMMUNICATION APPARATUS

CROSS-REFERENCE TO RELATED APPLICATIONS

This application is based upon and claims the benefit of priority of the prior Japanese Patent Application No. 2010-258270, filed on Nov. 18, 2010, the entire contents of which are incorporated herein by reference.

FIELD

The embodiments discussed herein are related to an antenna device and a wireless communication apparatus.

BACKGROUND

In recent years, attention has been given to multi-band antennas that can transmit and receive radio waves of a plurality of mutually different frequency bands. Specifically, different frequency bands, such as the 800 mega-hertz (MHz) band, 1.7 giga-hertz (GHz) band, and 2 GHz band, are currently used in radio communication systems in countries around the world, and therefore a multi-band antenna that can be used with the different frequency bands is under study.

Such a multi-band antenna typically includes antenna elements that resonate in response to respective radio waves in a plurality of frequency bands. When the multi-band antenna transmits or receives radio waves of any of the frequency bands, an antenna element corresponding to this frequency band resonates. Accordingly, in the case of increasing the number of frequency bands for which the antenna is suitable, the number of antenna elements tends to increase, which leads to an increase in the size of a multi-band antenna. To address this problem, various ideas regarding the shape of an antenna element have been proposed so as to reduce the size of a multi-band antenna.

Further, a structure in which a switch is coupled to an antenna element, and the switch is used to select whether power is fed to, for example, one antenna element or not, has been considered. This is intended to reduce the size of a multi-band antenna while allowing usage of the multi-band antenna with a plurality of frequency bands.

SUMMARY

According to an aspect of the embodiment, an antenna device includes a feed element being of a length that allows resonance in a specified frequency band, a distributed constant feed line grounded at one end and coupled at another end to the feed element to form a feeding point, a reactive element grounded at one end and coupled at another end to a position a specified distance from the feeding point of the feed line, a first switch disposed between the feed line and the reactive element and used to select whether the feed line and the reactive element are coupled or uncoupled, a parasitic element disposed adjacent to the feed element and being of a length that allows resonance in a frequency band different from the frequency band in which the feed element resonates, and a second switch used to select whether the parasitic element is grounded.

The object and advantages of the embodiment will be realized and attained at least by the elements, features, and combinations particularly pointed out in the claims.

It is to be understood that both the foregoing general description and the following detailed description are exemplary and explanatory and are not restrictive of the embodiment, as claimed.

BRIEF DESCRIPTION OF THE DRAWINGS

FIG. 5 is a table illustrating operation modes of the antenna device according to the embodiment.

DESCRIPTION OF EMBODIMENTS

The Third Generation Partnership Project (3GPP), a standardization organization for radio communication systems, is developing Long Term Evolution (LTE) as a new standard. When LTE is implemented, a frequency band of 1.5 GHz is expected to be used in addition to the currently used frequency bands of 800 MHz, 1.7 GHz, and 2 GHz.

Figure 12:
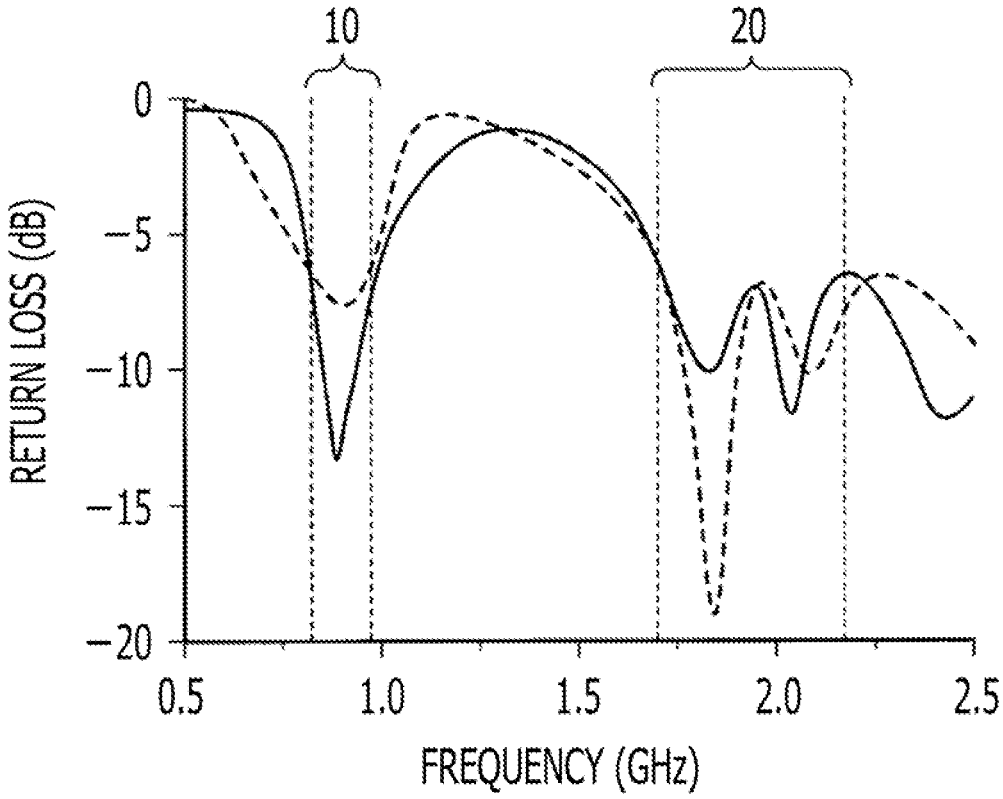
FIG. 12 is a graph illustrating a specific example of return losses of a multi-band antenna.

Unfortunately, the 1.5 GHz band is an intermediate frequency band between the 800 MHz band and the 1.7 GHz and 2 GHz bands that are currently used. This causes a problem in that it is difficult to transmit and receive radio waves in the 1.5 GHz band with high efficiency. Specifically, for example, as illustrated in FIG. 12, a multi-band antenna that has low return losses in a frequency band 10 of 800 MHz and in a frequency band 20 covering 1.7 GHz and 2 GHz has been considered.

The multi-band antenna transmits and receives radio waves in the frequency bands 10 and 20, where the return losses are low, with high efficiency, whereas the return loss is high in the frequency band of 1.5 GHz that is intermediate between these frequency bands. That is, the 1.5 GHz band is an anti-resonant frequency band for antenna elements that resonate in the conventional frequency bands 10 and 20. Therefore, even if an antenna element that is suitable for radio waves in the 1.5 GHz band is added, the return losses of other antenna elements are high, which results in low efficiency. Accordingly, merely adding an antenna element that resonates in the 1.5 GHz band does not enable a highly efficient multi-band antenna to be obtained.

Similarly, for example, regarding a frequency band of 2.5 GHz or more, there is an anti-resonant frequency band for conventional antenna elements that resonate in the 800 MHz band, the 1.7 GHz band, and the 2 GHz band. It is therefore not easy to obtain a multi-band antenna that can be used also with such a frequency band.

In consideration of such a point, an object of the disclosed technique is to provide an antenna device and a wireless communication apparatus capable of being used with an intermediate frequency band among a plurality of frequency bands in which radio waves can be transmitted and received with high efficiency.

An antenna device disclosed in this application includes, in an aspect thereof, a feed element being of a length that allows resonance in a specified frequency band, a distributed constant feed line grounded at one end and coupled at another end to the feed element to form a feeding point, a reactive element grounded at one end and coupled at another end to a position a specified distance from the feeding point of the feed line, a first switch disposed between the feed line and the reactive element and used to select whether the feed line and the reactive element are coupled or uncoupled, a parasitic element disposed adjacent to the feed element and being of a length that allows resonance in a frequency band different from the frequency band in which the feed element resonates, and a second switch used to select whether the parasitic element is grounded.

According to the aspect, the antenna device and the wireless communication apparatus disclosed in this application can successfully be used with an intermediate frequency band among a plurality of frequency bands in which radio waves can be transmitted and received with high efficiency.

Hereinbelow, an embodiment of the antenna device and the wireless communication apparatus disclosed in this application will be described in detail with reference to the accompanying drawings. It is to be understood that this embodiment does not limit the invention.

Figure 1:
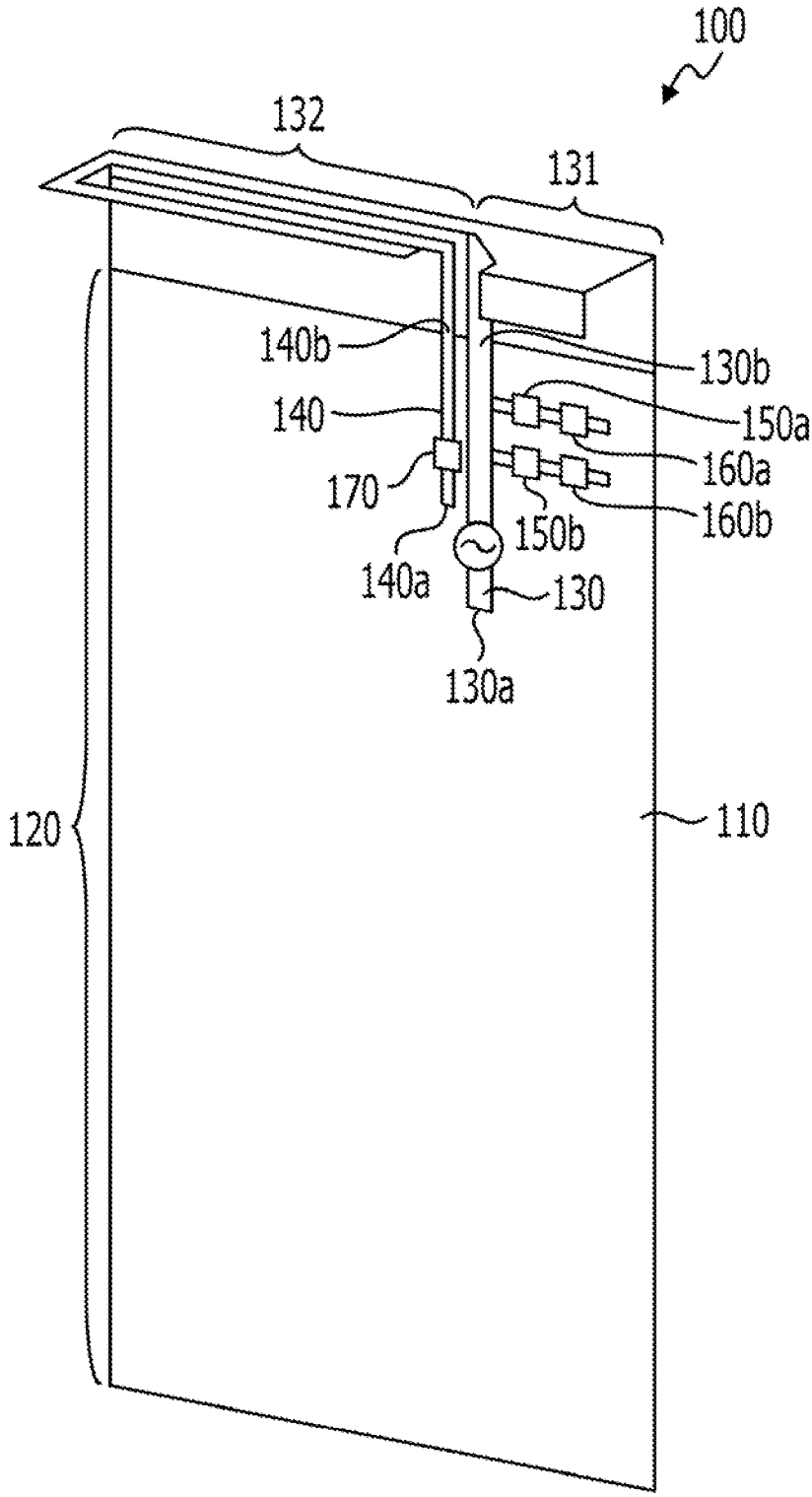
FIG. 1 is a perspective view illustrating a schematic structure of an antenna device according to an embodiment.

FIG. 1 is a perspective view illustrating a schematic structure of an antenna device 100 according to this embodiment. The antenna device 100 illustrated in FIG. 1 mainly includes a substrate 110, a ground layer 120, a feed line 130, feed elements 131 and 132, a parasitic element 140, switches 150*a* and 150*b*, inductance elements 160*a* and 160*b*, and a switch 170.

The substrate 110 is a plate member made of a dielectric or magnetic material, such as glass epoxy, ceramic, or ferrite. Disposed on one surface of the substrate 110 are the feed line 130, the feed elements 131 and 132, the parasitic element 140, the switches 150*a* and 150*b*, the inductance elements 160*a* and 160*b*, and the switch 170. On the other surface of the substrate 110, the ground layer 120 is formed.

The ground layer 120 is made of a conductor, such as copper, that has a ground voltage, and is formed on the surface on a back side of the substrate 110, which is not illustrated in FIG. 1. However, the ground layer 120 is formed not over the entire surface of the substrate 110 but in an area that does not include one end of the substrate 110 as illustrated in FIG. 1. That is, a copper foil having a thickness of about 0.035 mm is disposed over the area that does not include the one end of the substrate 110, so that the ground layer 120 is formed.

The feed line 130 is a distributed constant line including, for example, a microstrip line, a strip line or a coplanar line, and feeds power to the feed elements 131 and 132. The feed line 130, at one end 130*a*, passes through the substrate 110 via a through-hole (not illustrated) and is coupled to the ground layer 120. In one end of the area where the ground layer 120 is formed, a feeding point 130*b* for feeding power to the feed elements 131 and 132 is formed.

The feed elements 131 and 132 together form a T-monopole antenna coupled to the feed line 130, and are each formed in such a manner as to extend perpendicularly to a front side surface of the substrate 110 illustrated in FIG. 1. The feed element 131 resonates at relatively high frequency bands of 1.7 GHz and 2 GHz. In contrast, the feed element 132 resonates at a relatively low frequency band of 800 MHz. It is to be noted that details regarding the specific shapes of the feed elements 131 and 132 will be given later.

The parasitic element 140 is an inverted L-shaped element provided adjacent to the feed line 130 and the feed elements 131 and 132, and the parasitic element 140 at one end 140*a* passes through the substrate 110 via a through-hole (not illustrated) and is coupled to the ground layer 120. Near a point 140*b*, the parasitic element 140 is close to the feeding point 130*b* to allow electromagnetic coupling. The parasitic element 140 resonates in a frequency band of 1.5 GHz corresponding to an intermediate frequency band between the frequency bands in which the feed elements 131 and 132 resonate. The switch 170 is provided in the vicinity of the one end 140*a* of the parasitic element 140. It is to be noted that details regarding the specific shape of the parasitic element 140 will be given later.

The feed elements 131 and 132 and the parasitic element 140 can be formed of a metal sheet or the like that is a conductor, and can also be formed by printing a metal pattern on the substrate 110 or a film.

The switch 150*a* is used to select whether the feed line 130 and the inductance element 160*a* are coupled or uncoupled. That is, the switch 150*a* is disposed between the feed line 130 and the inductance element 160*a*. It is to be noted that the switch 150*a* is disposed within the area of the substrate 110 where the ground layer 120 is formed, and is coupled at, for example, a position 2.8 mm apart from the feeding point 130*b* of the feed line 130. The switch 150*a* causes the feed line 130 and the inductance element 160*a* to be coupled to vary the effective electrical length of the feed element 131 and the feed line 130, so that the antenna device 100 is suitable for the frequency band of 1.7 GHz.

The switch 150*b* is used to select whether the feed line 130 and the inductance element 160*b* are coupled or uncoupled. That is, the switch 150*b* is disposed between the feed line 130 and the inductance element 160*b*. It is to be noted that the switch 150*b* is disposed within the area of the substrate 110 where the ground layer 120 is formed, and is coupled to, for example, a position 4.0 mm apart from the feeding point 130*b* of the feed line 130. The switch 150*b* causes the feed line 130 and the inductance element 160*b* to be coupled to vary the effective electrical length of the feed element 132 and the feed line 130, so that the antenna device 100 is suitable for the frequency band of 800 MHz.

The switches 150*a* and 150*b* are disposed within the area of the substrate 110 where the ground layer 120 is formed. This can reduce the effect that a current flowing through a control line for controlling connection and disconnection of these switches exerts on the feed elements 131 and 132 and the parasitic element 140. It is to be noted that, for example, switches using Micro Electro Mechanical Systems (MEMS) or PIN diodes can be used as the switches 150*a* and 150*b*.

The inductance element 160*a* is an inductive element such as a coil. The inductance element 160*a* is coupled at one end to the switch 150*a*, and, at the other end, passes through the substrate 110 via a through-hole (not illustrated) and is coupled to the ground layer 120. By setting the inductance of the inductance element 160*a*, for example, at 5 nanohenries (nH), when the switch 150*a* is coupled, the antenna device 100 can be suitable for the frequency band of 1.7 GHz.

The inductance element 160*b* is an inductive element such as a coil. The inductance element 160*b* is coupled at one end to the switch 150*b*, and, at the other end, passes through the substrate 110 via a through-hole (not illustrated) and is coupled to the ground layer 120. By setting the inductance of the inductance element 160*b*, for example, at 8 nH, when the switch 150*b* is coupled, the antenna device 100 can be suitable for the frequency band of 800 MHz.

The switch 170 is provided in the vicinity of the one end 140*a* of the parasitic element 140, and is used to select whether the parasitic element 140 and the ground layer 120 are coupled or uncoupled. That is, the switch 170, when coupled, causes the parasitic element 140 to be grounded. The switch 170 connects the parasitic element 140 and the ground layer 120, thereby making the antenna device 100 suitable for the frequency band of 1.5 GHz. It is to be noted that the switch 170 is disposed within the area of the substrate 110 where the ground layer 120 is formed.

Since the switch 170 is disposed in the area of the substrate 110 where the ground layer 120 is formed, it is possible to reduce the effect that a current flowing through a control line for controlling connection and disconnection of the switch 170 exerts on the feed elements 131 and 132 and the parasitic element 140. It is to be noted that, for example, a switch using MEMS or a PIN diode can be used as the switch 170, as in the case of the switches 150*a* and 150*b*.

Figure 2:
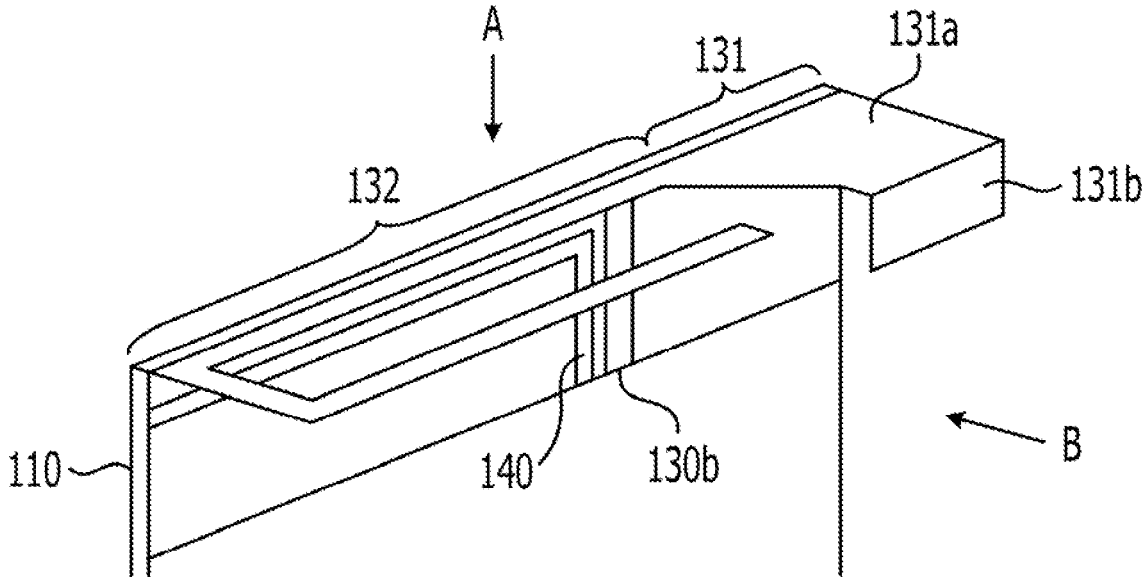
FIG. 2 illustrates a shape of an antenna element of the embodiment.

With reference to FIG. 2 and FIG. 3, the shapes of the feed elements 131 and 132 and the parasitic element 140 according to this embodiment will next be described specifically.

FIG. 2 illustrates a shape of an antenna element according to this embodiment. As illustrated in FIG. 2, both the feed elements 131 and 132 are coupled to the feeding point 130*b*, and a line passing through the feeding point 130*b* serves as a boundary that separates the feed elements 131 and 132 from each other. The feed elements 131 and 132 are formed on the side that is most distant from the ground layer 120 of the substrate 110. The feed element 131 includes a first sheet portion 131*a* extending perpendicularly to a surface of the substrate 110, and a second sheet portion 131*b* facing the surface of the substrate 110. The feed element 132 is formed by folding back a long and narrow metal sheet within a plane extending perpendicularly to the surface of the substrate 110.

On the other hand, the parasitic element 140 is disposed at a position closer to the ground layer 120 than the feed elements 131 and 132, and is formed by arranging an inverted L-shaped metal sheet on the surface of the substrate 110. In this embodiment, part of the parasitic element 140 is close to the feeding point 130*b*, and therefore the parasitic element 140 and the feeding point 130*b* are electromagnetically coupled to each other to increase the current flowing through the parasitic element 140. This results in a good suitability state of the antenna device 100.

Figure 3A:
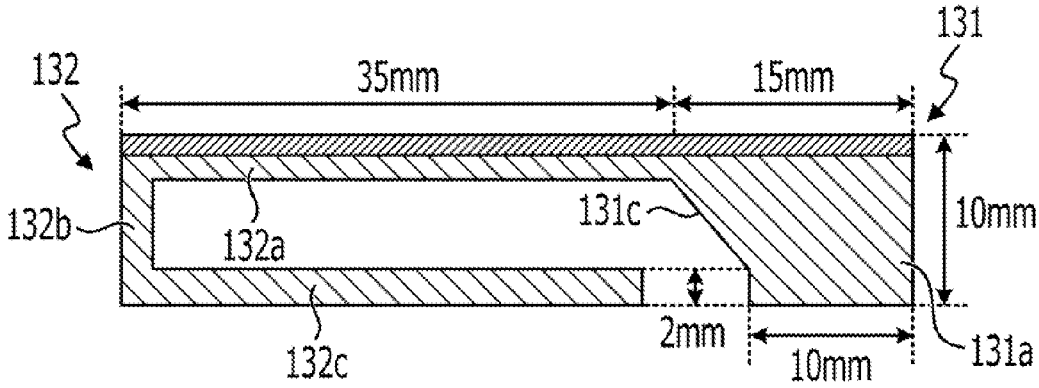
FIG. 3A illustrates the feed elements 131 and 132 as seen from the direction of A of FIG. 2.
Figure 3B:
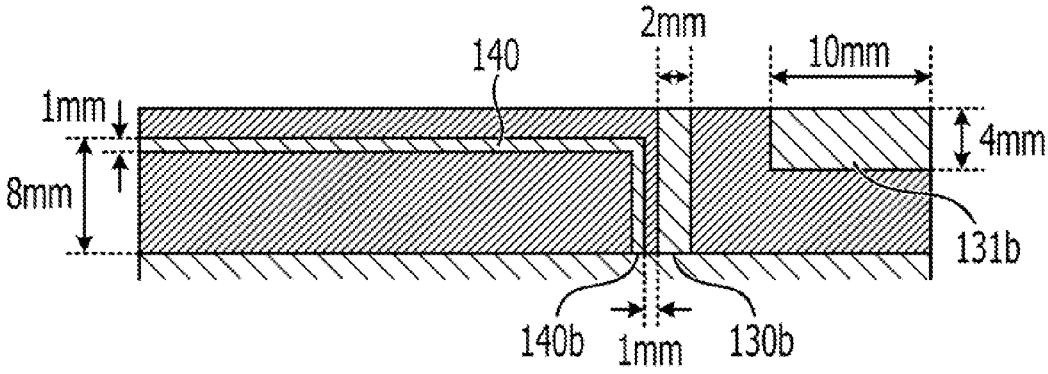
FIG. 3B illustrates the feed element 131 and parasitic element 140 as seen from the direction of B of FIG. 2.

FIGS. 3A and 3B illustrate the antenna element according to this embodiment as seen in directions of A and B of FIG. 2. That is, FIG. 3A represents the feed elements 131 and 132 as seen from the direction of A of FIG. 2, and FIG. 3B represents the feed element 131 and parasitic element 140 as seen from the direction of B of FIG. 2.

As illustrated in the FIG. 3A, the first sheet portion 131*a* of the feed element 131 is nearly trapezoidal. Specifically, the first sheet portion 131*a* has a nearly trapezoidal shape that has a side, for example, 15 mm in length on the side of the substrate 110, that has a side, for example, 10 mm in length parallel to this side, and that is 10 mm in height. As a result, a hypotenuse 131*c* is formed on the side of the feed element 132 of the first sheet portion 131*a*. As such, the first sheet portion 131*a* is formed in the above-described tapering shape, which expands the frequency bands of 1.7 GHz and 2 GHz in which the feed element 131 resonates, and secures the distance between the feed element 131 and the feed element 132 to reduce the effects of the feed element 131 and the feed element 132 that are exerted on each other.

The second sheet portion 131*b* is coupled to a side distant from the substrate 110 of the first sheet portion 131*a* as illustrated in the lower illustration of FIG. 3. The second sheet portion 131*b* has a rectangular shape that is, for example, 10 mm in width and 4 mm in height. As such, the second sheet portion 131*b* is formed in such a manner as to be folded back from an end of the first sheet portion 131*a*, so that a required element length is secured in a limited space. This reduces the size of the antenna device 100 and, at the same time, enables the antenna device 100 to be used with the frequency bands of 1.7 GHz and 2 GHz.

As illustrated in FIG. 3A, the feed element 132 is formed by folding back a long and narrow metal sheet having a width of, for example, 2 mm. Specifically, the feed element 132 includes a first extension portion 132*a* extending, for example, 35 mm along the surface of the substrate 110, a second extension portion 132*b* extending perpendicularly to the surface of the substrate 110, and a third extension portion 132*c* folded back parallel to the surface of the substrate 110. The first extension portion 132*a*, the second extension portion 132*b*, and the third extension portion 132*c* are formed in this manner so as to secure a relatively long element length in a limited space. This reduces the size of the antenna device 100 and, at the same time, enables the antenna device 100 to be used with the frequency band of 800 MHz.

On the other hand, as illustrated in FIG. 3B, the parasitic element 140 is an antenna element in which a long and narrow metal sheet having a width of, for example, 1 mm is formed in an inverted L-shape. The portion of the parasitic element 140 that is most distant from the ground layer 120 is located, for example, 8 mm from the ground layer 120, and the feed elements 131 and 132 are yet further from the ground layer 120. Therefore, the frequency bands for which the feed elements 131 and 132 are suitable can be expanded. In contrast, the frequency band for which the parasitic element 140 is suitable is narrower than those for which the feed elements 131 and 132 are suitable. This, however, is not problematic because the frequency band that the parasitic element 140 covers is a relatively narrow bandwidth as will be described later.

Part of the parasitic element 140 near the point 140*b* is close to the feeding point 130*b* with a spacing of, for example, 1 mm there between. Therefore, the parasitic element 140 and the feeding point 130*b* are electromagnetically coupled to each other to increase the current flowing through the parasitic element 140. This results in a good suitability state of the antenna device 100.

Figure 4:
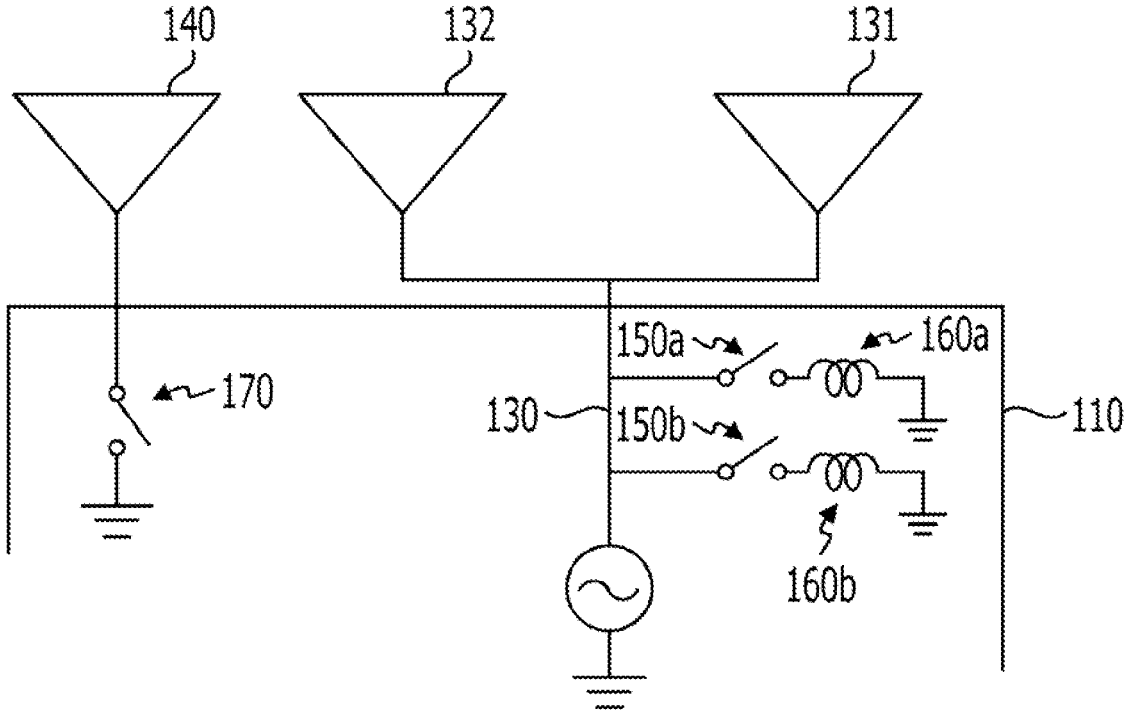
FIG. 4 is a diagram illustrating an equivalent circuit of the antenna device according to the embodiment.

Operation of the antenna device 100 configured as described above will next be described. FIG. 4 illustrates an equivalent circuit of the antenna device 100 according to this embodiment. That is, as illustrated in FIG. 4, one end of the feed line 130 is grounded, the feed elements 131 and 132 are coupled to the other end of the feed line 130, and the inductance elements 160*a* and 160*b* are coupled to the center of the feed line 130 via the switches 150*a* and 150*b*. One end of the inductance element 160*a* and one end of the inductance element 160*b* are also grounded. The parasitic element 140 is disposed adjacent to the feed elements 131 and 132, and one end of the parasitic element 140 is grounded via the switch 170.

The antenna device 100 according to this embodiment can be used with four frequency bands by using three antenna elements, the feed elements 131 and 132 and the parasitic element 140, by connecting and disconnecting the switches 150*a*, 150*b*, and 170. Specifically, the antenna device 100 can be used with four frequency bands, 800 MHz band, 1.5 GHz band, 1.7 GHz band, and 2 GHz band to transmit and receive radio waves in these frequency bands. These frequency bands correspond to four bands illustrated in FIG. 5.

Hereinbelow, a description will be given of operation modes of the antenna device 100 respectively corresponding to the four bands illustrated in FIG. 5. Among the four bands illustrated in FIG. 5, Band 1 corresponds to the 800 MHz band, and is used in radio communication systems that employ communication systems such as FOMA (registered trademark) Plus, Global System for Mobile Communications (GSM)800, and GSM900. Similarly, Band 2 corresponds to the 1.5 GHz band, and is due to be used in a radio communication system employing, for example, LTE. Bands 3 and 4 are used in radio communication systems employing communication systems such as FOMA, GSM1800, and GSM1900.

The center frequencies of Bands 1 to 4 illustrated in FIG. 5 are 883 MHz, 1479.4 MHz, 1795 MHz, and 2008.8 MHz, corresponding to the 800 MHz band, the 1.5 GHz band, the 1.7 GHz band, and the 2 GHz band, respectively. It is to be noted that Band 2 has a bandwidth of 63 MHz, which is narrower than Bands 1, 3, and 4. The antenna device 100 according to this embodiment has operation modes respectively corresponding to Bands 1 to 4.

Operation Mode 1 is an operation mode in which all the switches 150*a*, 150*b*, and 170 are uncoupled. In this operation mode, the feed line 130 in the range where the ground layer 120 is formed does not contribute to the phase rotation of radio waves, and therefore a portion from the feeding point 130*b* to the end of the feed element 131 forms one antenna element. The length of this antenna element is a length that allows resonance in Band 4, and therefore suitability with Band 4 is obtained in Operation Mode 1. Specifically, the entire length from the feeding point 130*b* to the end of the second sheet portion 131*b* of the feed element 131 is a length that allows resonance with radio waves in the 2 GHz band of Band 4. As such, in Operation Mode 1, the portion from the feeding point 130*b* to the end of the feed element 131 resonates in Band 4, so that a current is generated. This enables radio waves of Band 4 to be transmitted and received.

Figure 6:
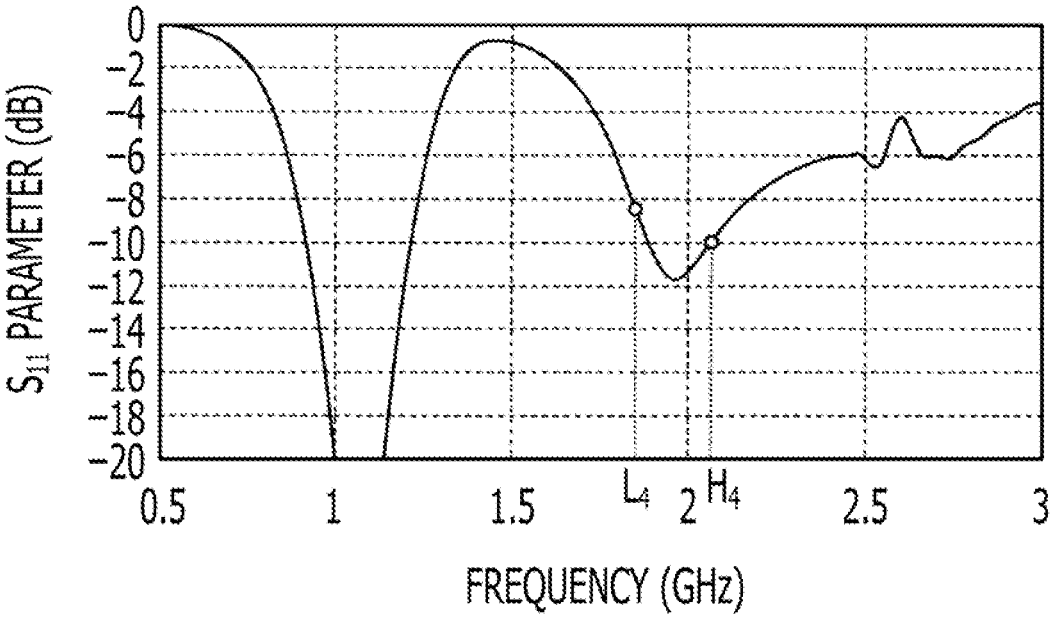
FIG. 6 is a graph illustrating a specific example of an $S_{11}$ parameter in Operation Mode 1.

A specific example of an $S_{11}$ parameter in Operation Mode 1 is illustrated in FIG. 6. It is to be noted that the $S_{11}$ parameter is a parameter representing the suitability state of the antenna device 100, and the antenna device 100 is in a good suitability state in a frequency band in which the $S_{11}$ parameter is in general −6 dB or less. As is apparent from FIG. 6, in Operation Mode 1, the $S_{11}$ parameter is −6 dB or less in a section from a lower cut-off frequency $L_4$ (1850 MHz) to an upper limited frequency $H_4$ (2167.6 MHz) of Band 4, which results in good suitability with Band 4.

Further, in Operation Mode 1, the $S_{11}$ parameter is relatively large in Bands 1 to 3 other than Band 4, which results in unsuitability with Bands 1 to 3. For this reason, in the case of receiving radio waves of, for example, Band 4, the receiving levels of Bands 1 to 3 are low, which reduces or eliminates the need for a filter or the like for decreasing the receiving levels of Bands 1 to 3. As a result, it is possible to reduce manufacturing costs for a wireless communication apparatus including the antenna device 100.

Figure 7:
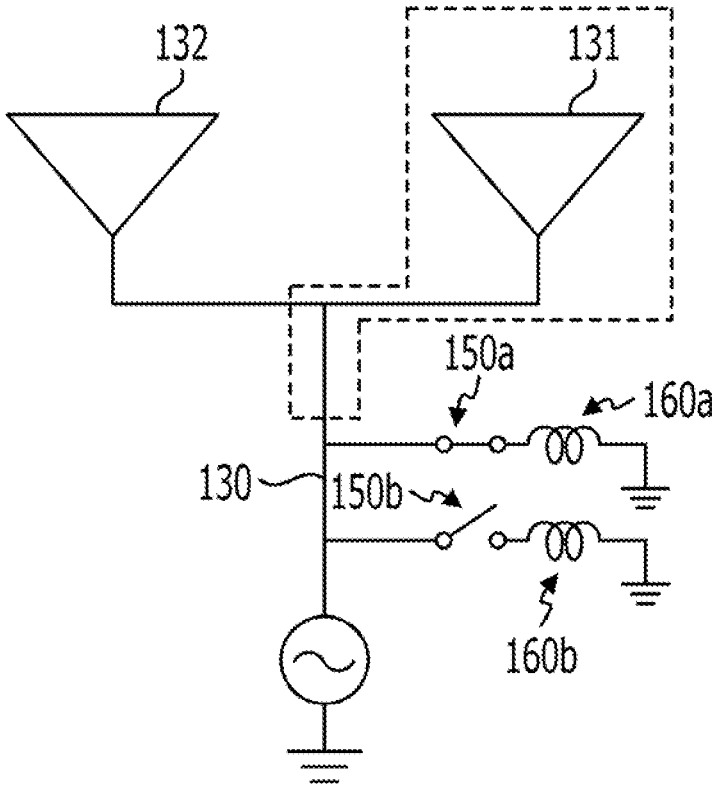
FIG. 7 is a diagram illustrating Operation Mode 2.

Next, Operation Mode 2 is an operation mode in which only the switch 150*a* is coupled. At this point, a portion from the feeding point 130*b* to a position of the feed line 130 at which the switch 150*a* is coupled, in addition to the feed element 131, contributes to the phase rotation of radio waves, and a portion surrounded by a broken line illustrated in FIG. 7 forms one antenna element. This antenna element is of a length that allows resonance in Band 3, and therefore suitability with Band 3 is obtained in Operation Mode 2. Specifically, the entire length from the position of the feed line 130 at which the switch 150*a* is coupled to the end of the second sheet portion 131*b* of the feed element 131 is a length that allows resonance with radio waves in the 1.7 GHz band of Band 3. As such, in Operation Mode 2, the portion from the position of the feed line 130 at which the switch 150*a* is coupled to the end of the second sheet portion 131*b* of the feed element 131 resonates in Band 3, so that a current is generated. This enables radio waves of Band 3 to be transmitted and received. In other words, in Operation Mode 2, the electrical length of the antenna element is longer than that in Operation Mode 1, which shifts the resonance frequency to lower values, and therefore suitability with Band 3, which is lower in frequency than Band 4, is obtained.

Here in Operation Mode 2, the switch 150*a* is coupled, which causes the feed line 130 and the ground layer 120 to be coupled via the inductance element 160*a*, and therefore the suitability state can be kept good. A brief description will be given of this respect.

In general, an antenna impedance $Z_L$ at a frequency $f_o$ is expressed by the following equation (1).

$$Z_L = R_{f0} + jX_{f0} \tag{1}$$

Here, $R_{f0}$ corresponds to the real number component of the impedance $Z_L$, and $X_{f0}$ corresponds to the imaginary number component of the impedance $Z_L$. At this point, the case is considered in which a line of a length l expressed by the following equation (2) is coupled to the feeding point, and the phase of the antenna impedance $Z_L$ as seen from a wave source is rotated.

$$l = \frac{1}{\beta}\tan^{-1}\left[\frac{-X_{f0}Z_0 \pm \sqrt{(X_{f0}Z_0)^2 - (Z_0^2 - R_{f0}Z_0)(X_{f0}^2 + R_{f0}^2 - Z_0R_{f0})}}{Z_0^2 - R_{f0}Z_0}\right] \tag{2}$$

It is to be noted that, in the above equation (2), $Z_0$ is a reference impedance of the line, and β is a phase constant. Depending on the line of such the length l, the phase of the antenna impedance $Z_L$ as seen from the wave source varies, and thus the suitability state of the antenna varies. To address this, assuming that the imaginary part of the admittance of the entirety including the line coupled to the feeding point is B, an inductance element having an inductance as large as to cancel B is coupled to the line. This can shift the resonance frequency without variation of the suitability state of the antenna. That is, an inductance element having an inductance $L_{ind}$ whose magnitude is expressed by the following equation (3) may be coupled to the line.

$$L_{ind} = \frac{1}{2\pi f_0 B} \tag{3}$$

In Operation Mode 2 according to this embodiment, since the length from the feeding point 130*b* to the position of the feed line 130 at which the switch 150*a* is coupled is 2.8 mm, the length l of the above equation (2) is 2.8 mm. The inductance $L_{ind}$ of the above equation (3) in this case is 5 nH, and therefore the inductance of the inductance element 160*a* is 5 nH. By setting the connection position of the switch 150*a* and the inductance of the inductance element 160*a* as mentioned above, the suitability state with Band 3 can be kept good in Operation Mode 2.

Figure 8:
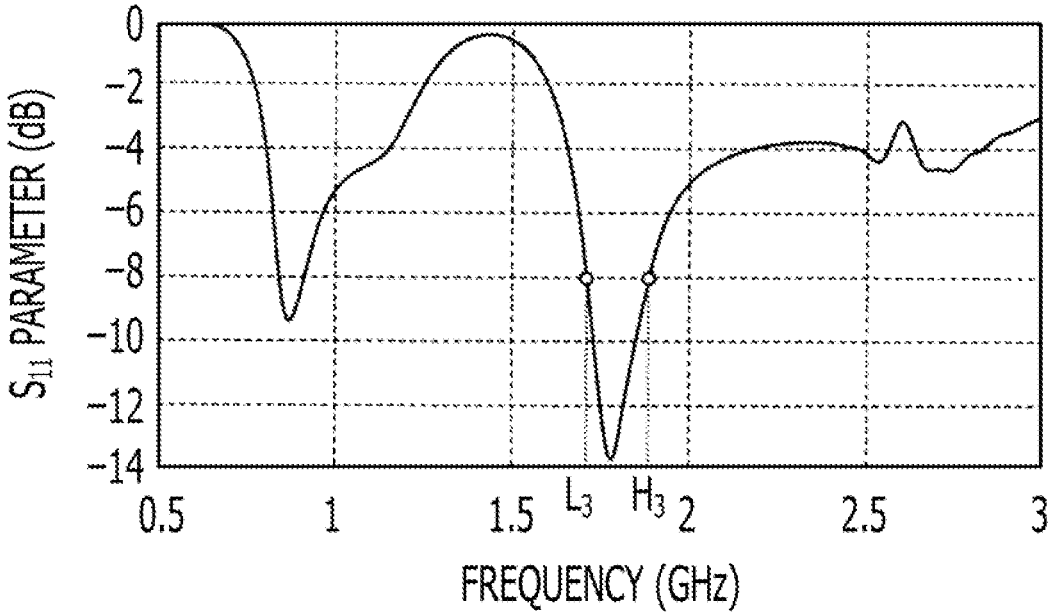
FIG. 8 is a graph illustrating a specific example of the $S_{11}$ parameter in Operation Mode 2.

A specific example of the $S_{11}$ parameter in Operation Mode 2 is illustrated in FIG. 8. As is apparent from FIG. 8, in Operation Mode 2, the $S_{11}$ parameter is −6 dB or less in a section from a lower cut-off frequency $L_3$ (1710 MHz) to an upper limited frequency $H_3$ (1880 MHz) of Band 3, which results in good suitability with Band 3.

Further, in Operation Mode 2, the $S_{11}$ parameter is relatively large in Bands 1, 2, and 4 other than Band 3, which results in unsuitability with Bands 1, 2, and 4. For this reason, in the case of receiving radio waves of, for example, Band 3, the receiving levels of Bands 1, 2, and 4 are low, which reduces or eliminates the need for a filter or the like for decreasing the receiving levels of Bands 1, 2, and 4. As a result, it is possible to reduce manufacturing costs for a wireless communication apparatus including the antenna device 100.

Figure 9:
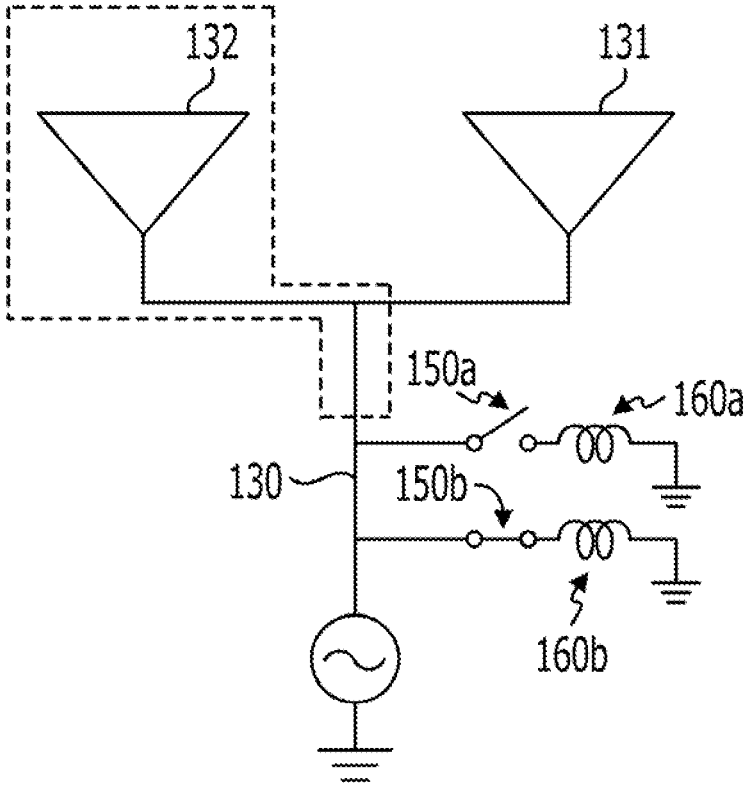
FIG. 9 is a diagram illustrating Operation Mode 3.

Next, Operation Mode 3 is an operation mode in which only the switch 150*b* is coupled. At this point, a portion from the feeding point 130*b* to a position of the feed line 130 at which the switch 150*b* is coupled, in addition to the feed element 132, contributes to the phase rotation of radio waves, and a portion surrounded by a broken line illustrated in FIG. 9 forms one antenna element. This antenna element is of a length that allows resonance in Band 1, and therefore suitability with Band 1 is obtained in Operation Mode 3. Specifically, the entire length from the position of the feed line 130 at which the switch 150*b* is coupled to the end of the third extension portion 132*c* of the feed element 132 is a length that allows resonance with radio waves in the 800 MHz band of Band 1. As such, in Operation Mode 3, the portion from the position of the feed line 130 at which the switch 150*b* is coupled to the end of the third extension portion 132*c* of the feed element 132 resonates in Band 1, so that a current is generated. This enables radio waves of Band 1 to be transmitted and received. In other words, in Operation Mode 3, the electrical length of the antenna element is longer than those in Operation Modes 1 and 2, which shifts the resonance frequency to lower values, and therefore suitability with Band 1, which is lower in frequency than Bands 3 and 4, is obtained.

Here in Operation Mode 3, the switch 150*b* is coupled, which causes the feed line 130 and the ground layer 120 to be coupled via the inductance element 160*b*, and therefore the suitability state can be kept good. That is, as in Operation Mode 2 described above, the relation between the position of the feed line 130 at which the switch 150*b* is coupled and the inductance of the inductance element 160*b* is set as appropriate, which makes it possible to vary the resonance frequency while keeping the suitability state good.

In Operation Mode 3 according to this embodiment, since the length from the feeding point 130*b* to the position of the feed line 130 at which the switch 150*b* is coupled is 4.0 mm, the length l of the above equation (2) is 4.0 mm. The inductance $L_{ind}$ of the above equation (3) in this case is 8 nH, and therefore the inductance of the inductance element 160*b* is 8 nH. By setting the connection position of the switch 150*b* and the inductance of the inductance element 160*b* as mentioned above, the suitability state with Band 1 can be kept good in Operation Mode 3.

Figure 10A:
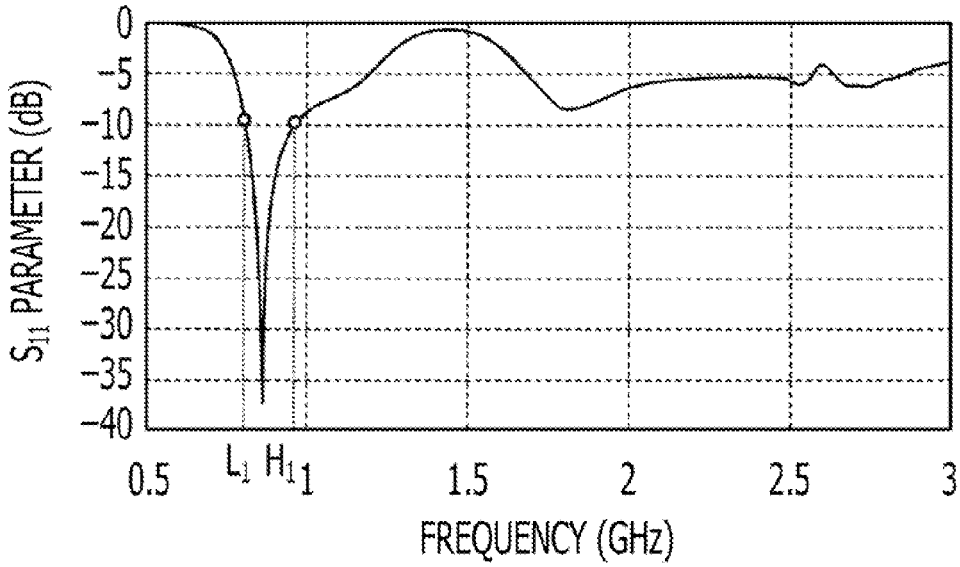
FIG. 10A is a graph illustrating a specific example of the $S_{11}$ parameter in Operation Mode 3.

A specific example of the $S_{11}$ parameter in Operation Mode 3 is illustrated in FIG. 10A. As is apparent from FIG. 10A, in Operation Mode 3, the $S_{11}$ parameter is −6 dB or less in a section from a lower cut-off frequency $L_1$ (806 MHz) to an upper limited frequency $H_1$ (960 MHz) of Band 1, which results in good suitability with Band 1.

Further, in Operation Mode 3, the $S_{11}$ parameter is relatively large in Bands 2 to 4 other than Band 1, which results in unsuitability with Bands 2 to 4. For this reason, in the case of receiving radio waves of, for example, Band 1, the receiving levels of Bands 2 to 4 are low, which reduces or eliminates the need for a filter or the like for decreasing the receiving levels of Bands 2 to 4. As a result, it is possible to reduce manufacturing costs for a wireless communication apparatus including the antenna device 100.

Next, Operation Mode 4 is an operation mode in which only the switch 170 is coupled. At this point, the parasitic element 140 is coupled via the switch 170 to the ground layer 120, and operates as an antenna element. The parasitic element 140 is of a length that allows resonance in Band 2, and therefore suitability with Band 2 is obtained in Operation Mode 2. Part of the parasitic element 140 is close to the feeding point 130*b*, and therefore the current amount increases owing to electromagnetic coupling when the parasitic element 140 is used with Band 2. As a result, the sensitivity to Band 2 increases compared to the case where the parasitic element 140 is singly disposed.

Figure 10B:
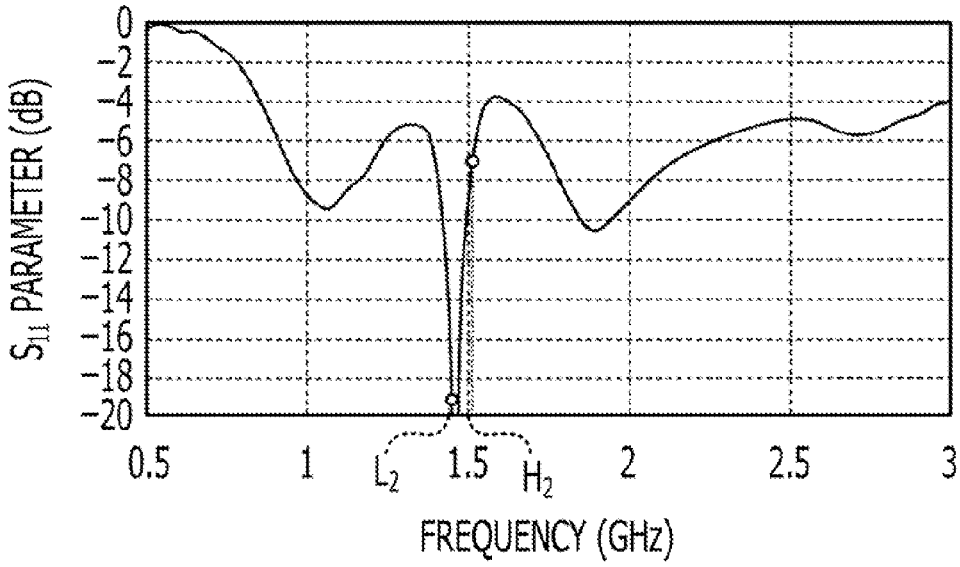
FIG. 10B is a graph illustrating a specific example of the $S_{11}$ parameter in Operation Mode 4.

A specific example of the $S_{11}$ parameter in Operation Mode 4 is illustrated in FIG. 10B. As is apparent from FIG. 10B, in Operation Mode 4, the $S_{11}$ parameter is −6 dB or less in a section from a lower cut-off frequency $L_2$ (1447.9 MHz) to an upper limited frequency $H_2$ (1510.9 MHz) of Band 2, which results in good suitability with Band 2.

As described above, connecting and disconnecting the switches 150*a*, 150*b*, and 170 enables Operation Modes 1 to 4 of the antenna device 100 to be implemented, so that the antenna device 100 can be used with Bands 1 to 4 corresponding to the respective operation modes. That is, the antenna device 100 can be used with the 1.5 GHz band, which corresponds to the intermediate frequency band between the 800 MHz band and the 1.7 GHz and 2 GHz bands, and thus the antenna device 100 can be used with the intermediate frequency band among a plurality of frequency bands in which radio waves can be transmitted and received with high efficiency.

Figure 11:
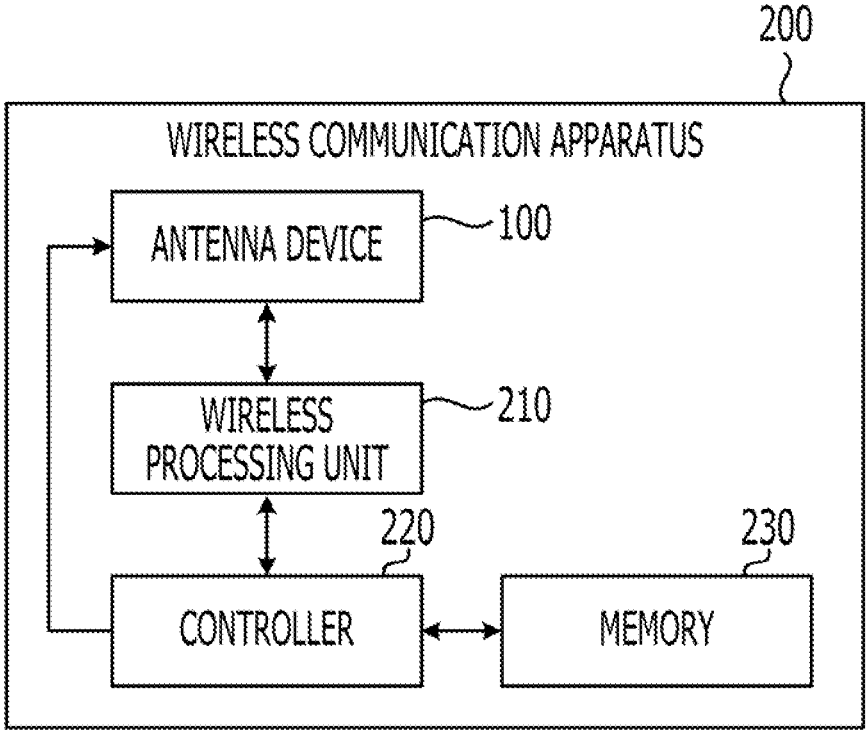
FIG. 11 is a block diagram illustrating a configuration of a wireless communication apparatus according to the embodiment.

The antenna device 100 according to this embodiment can be mounted on a wireless communication apparatus such as a cellular phone. FIG. 11 is a block diagram illustrating a configuration of a wireless communication apparatus 200 including the antenna device 100. As illustrated in FIG. 11, the wireless communication apparatus 200 includes the antenna device 100, a wireless processing unit 210, a controller 220, and a memory 230.

The wireless processing unit 210 performs wireless processing of signals transmitted and received by the antenna device 100. Specifically, the wireless processing unit 210, for example, down-converts a signal received by the antenna device 100, and up-converts a signal output from the controller 220 to a signal to be transmitted from the antenna device 100.

The controller 220 performs overall control of communication processing by the wireless communication apparatus 200. Specifically, the controller 220, for example, decodes a received signal of which wireless processing has been performed by the wireless processing unit 210, and encodes a desired signal and outputs the signal to the wireless processing unit 210. Also, the controller 220 causes the switches 150*a*, 150*b*, and 170 of the antenna device 100 to be coupled and uncoupled to set the antenna device 100 to any of the above-described Operation Modes 1 to 4.

That is, for example, upon detecting that the radio communication system to which the wireless communication apparatus 200 belongs uses radio waves of Band 1, the controller 220 causes only the switch 150*b* to be in a coupled state to set the antenna device 100 to Operation Mode 3. Similarly, upon detecting that the radio communication system to which the wireless communication apparatus 200 belongs uses radio waves of Band 4, the controller 220 causes all the switches to be in a uncoupled state to set the antenna device 100 to Operation Mode 1. It is to be noted that setting of operation modes may be performed automatically by automatic detection of the frequency band used in a radio communication system, and may also be performed in accordance with a user's operation.

The memory 230 stores information required at the time of processing performed by the controller 220. Specifically, the memory 230 stores, for example, information such as corresponding relations between the frequency band and the operation mode used in a radio communication system.

As such, the wireless communication apparatus 200 includes the antenna device 100, and makes a selection among Operation Modes 1 to 4 depending on the frequency band to be used. Therefore, communication can be performed among a plurality of different radio communication systems.

As described above, according to this embodiment, an inductance element is coupled via a switch to a feed line for feeding power to a feed element, a parasitic element is disposed adjacent to the feed element, and the parasitic element is grounded via a switch. By connecting and disconnecting switches, the feed element can resonate in a plurality of frequency bands, and the grounded parasitic element can resonate in an intermediate frequency band among these frequency bands. As a result, the antenna device can be used with an intermediate frequency band among a plurality of frequency bands in which radio waves can be transmitted and received by the feed element with high efficiency.

It is to be noted that, in the foregoing embodiment, the inductance elements 160*a* and 160*b* are coupled via the switches 150*a* and 150*b* to the feed line 130; however, for example, capacitance elements such as capacitors may be used instead of the inductance elements. That is, various reactive elements may be used as long as they are reactive elements that vary reactances so as to keep the suitability state good when the switches 150*a* and 150*b* are coupled.

In the foregoing embodiment, the antenna device 100 that can be used with four frequency bands, the 800 MHz band, 1.5 GHz band, 1.7 GHz band, and 2 GHz band, has been described; however, the frequency bands are not limited to these four. That is, even in cases where the antenna device is used with a frequency band higher than the currently used frequency bands, in addition to the currently used frequency bands, a configuration in which a parasitic element is disposed adjacent to a feed element so as to be able to be grounded may be employed as in the foregoing embodiment.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Although the embodiment (s) of the present invention(s) has(have) been described in detail, it should be understood that the various changes, substitutions, and alterations could be made hereto without departing from the spirit and scope of the invention.

What is claimed is:

1. An antenna device comprising:

a feed element being of a length that allows resonance in a specified frequency band;

a distributed constant feed line grounded at one end and coupled at another end to the feed element to form a feeding point;

a reactive element grounded at one end and coupled at another end to a position a specified distance from the feeding point of the feed line;

a first switch disposed between the feed line and the reactive element and used to select whether the feed line and the reactive element are coupled or uncoupled;

a parasitic element disposed adjacent to the feed element and being of a length that allows resonance in a frequency band different from the frequency band in which the feed element resonates; and a second switch used to select whether the parasitic element is grounded, the first switch and the second switch being controlled to be in a uncoupled state in a case of transmitting and receiving a signal in a first frequency band, the first switch being controlled to be in a coupled state in a case of transmitting and receiving a signal in a second frequency band, and the second switch being controlled to be in a coupled state in a case of transmitting and receiving a signal in a third frequency band.

2. The antenna device according to claim 1, further comprising:

a substrate; and a ground unit at a ground voltage formed in a range of part of one surface of the substrate, wherein the feed line and the reactive element are each coupled at one end to the ground unit.

3. The antenna device according to claim 2, wherein the feed element includes a portion extending perpendicularly to a surface of the substrate on a side most distant from the ground unit of the substrate.

4. The antenna device according to claim 3, wherein the feed element includes a first sheet portion extending perpendicularly to the surface of the substrate; and a second sheet portion extending from an end of the first sheet portion and being parallel to the surface of the substrate.

5. The antenna device according to claim 4, wherein the first sheet portion has a nearly trapezoidal shape with a width decreasing with an increasing distance from the surface of the substrate.

6. The antenna device according to claim 3, wherein the feed element is formed such that an extension portion is disposed perpendicularly to the surface of the substrate, the extension portion being formed by folding back conductor within one plane.

7. The antenna device according to claim 2, wherein the first switch is disposed on a back side within an area of the substrate where the ground unit is formed.

8. The antenna device according to claim 2, wherein the second switch is disposed on a back side within an area of the substrate where the ground unit is formed.

9. The antenna device according to claim 1, wherein the parasitic element is disposed such that at least part of the parasitic element is close to the feeding point.

10. The antenna device according to claim 2, wherein the parasitic element resonates in a frequency band that is narrower than the frequency band in which the feed element resonates, and is disposed closer to the ground unit than the feed element.

11. The antenna device according to claim 1, wherein the first switch switches the feed line and the reactive element from being uncoupled to being coupled in a case of decreasing the frequency band in which the feed element resonates.

12. The antenna device according to claim 1, wherein the second switch causes the parasitic element to be grounded when the first switch causes the feed line and the reactive element to be uncoupled.

13. A wireless communication apparatus comprising:

an antenna device including a feed element being of a length that allows resonance in a specified frequency band;

a distributed constant feed line grounded at one end and coupled at another end to the feed element to form a feeding point;

a reactive element grounded at one end and coupled at another end to a position a specified distance from the feeding point of the feed line;

a first switch disposed between the feed line and the reactive element and used to select whether the feed line and the reactive element are coupled or uncoupled;

a parasitic element disposed adjacent to the feed element and being of a length that allows resonance in a frequency band different from the frequency band in which the feed element resonates; and a second switch used to select whether the parasitic element is grounded; and a controller that causes the first switch and the second switch to be in a uncoupled state in a case of transmitting and receiving a signal in a first frequency band, causes the first switch to be in a coupled state in a case of transmitting and receiving a signal in a second frequency band, and causes the second switch to be in a coupled state in a case of transmitting and receiving a signal in a third frequency band.

14. An antenna device comprising:

a feed element being of a length that allows resonance in a specified frequency band;

a distributed constant feed line grounded at one end and coupled at another end to the feed element to form a feeding point;

a reactive element grounded at one end and coupled at another end to a position a specified distance from the feeding point of the feed line;

a first switch disposed between the feed line and the reactive element and used to select whether the feed line and the reactive element are coupled or uncoupled;

a parasitic element disposed adjacent to the feed element and being of a length that allows resonance in a frequency band different from the frequency band in which the feed element resonates; and a second switch used to select whether the parasitic element is grounded, wherein the feed element includes a first portion and a second portion that allows resonance in a frequency band lower than a frequency band in which the first portion allows resonance, the antenna device is operated in a first frequency band, when the first switch causes the feed line and the reactive element to be uncoupled and the second switch causes the parasitic element to be ungrounded, the antenna device is operated in a second frequency band, when the first switch causes the feed line and the reactive element to be coupled and causes the first portion to be in a resonance state, the antenna device is operated in a third frequency band, when the first switch causes the feed line and the reactive element to be coupled and causes the second portion to be in a resonance state, and the antenna device is operated in a fourth frequency band, when the first switch causes the feed line and the reactive element to be coupled, the fourth frequency band being lower than the first frequency band and the second frequency band and higher than the third frequency band.

15. A wireless communication apparatus comprising:

an antenna device including a feed element being of a length that allows resonance in a specified frequency band;

a distributed constant feed line grounded at one end and coupled at another end to the feed element to form a feeding point;

a reactive element grounded at one end and coupled at another end to a position a specified distance from the feeding point of the feed line;

a first switch disposed between the feed line and the reactive element and used to select whether the feed line and the reactive element are coupled or uncoupled;

a parasitic element disposed adjacent to the feed element and being of a length that allows resonance in a frequency band different from the frequency band in which the feed element resonates; and a second switch used to select whether the parasitic element is grounded, the feed element including a first portion and a second portion that allows resonance in a frequency band lower than a frequency band in which the first portion allows resonance; and a controller that causes the first switch and the second switch to be in a uncoupled state in a case of transmitting and receiving a signal in a first frequency band, causes the first switch to be in a coupled state and the first portion to be in a resonance state in a case of transmitting and receiving a signal in a second frequency band, and causes the first switch to be in a coupled state and the second portion to be in a resonance state in a case of transmitting and receiving a signal in a third frequency band, and causes the second switch to be in a coupled state in a case of transmitting and receiving a signal in a fourth frequency band, the fourth frequency band being lower than the first frequency band and the second frequency band and higher than the third frequency band.

* * * * *